United States Patent [19]

Willberg

[11] Patent Number: 4,724,965

[45] Date of Patent: Feb. 16, 1988

[54] DEVICE FOR CONVEYING COMPONENTS, PARTICULARLY INTEGRATED CHIPS, FROM AN INPUT MAGAZINE TO AN OUTPUT MAGAZINE

[76] Inventor: Hans-Heinrich Willberg, Rottenbucherstrasse 9, D-8000 München 70, Fed. Rep. of Germany

[21] Appl. No.: 919,630

[22] Filed: Oct. 15, 1986

Related U.S. Application Data

[60] Division of Ser. No. 823,818, Jan. 28, 1986, abandoned, which is a continuation of Ser. No. 666,875, Oct. 31, 1984, abandoned.

[30] Foreign Application Priority Data

Nov. 7, 1983 [DE] Fed. Rep. of Germany ..... 3340182

[51] Int. Cl.[4] ..... B07C 5/344

[52] U.S. Cl. ..... 209/573; 193/39; 198/463.4; 198/532; 209/941; 221/264; 414/404

[58] Field of Search ..... 209/542, 543, 573, 941; 198/463.4, 463.5, 360, 532.; 414/404, 414, 222, 224; 193/39; 406/74; 221/12, 13, 258, 262, 264, 268, 289, 68; 324/158 F

[56] References Cited

U.S. PATENT DOCUMENTS

| | | | |
|---|---|---|---|
| 3,017,025 | 4/1960 | Stephen | 209/81 |
| 3,727,757 | 4/1973 | Boissicat | 209/573 |
| 4,000,798 | 1/1977 | Cedrone | 193/40 |
| 4,234,418 | 11/1980 | Boissicat | 209/545 |
| 4,316,754 | 2/1982 | Hinchcliffe et al. | 198/347 |
| 4,478,352 | 10/1984 | Amundson et al. | 221/13 |
| 4,588,092 | 5/1986 | Moechnig et al. | 209/573 |
| 4,601,382 | 7/1986 | Roberts et al. | 198/463.5 |

FOREIGN PATENT DOCUMENTS

| | | | |
|---|---|---|---|
| 0007650 | 2/1980 | European Pat. Off. . | |
| 2855913 | 6/1980 | Fed. Rep. of Germany . | |
| 0015568 | 1/1985 | Japan | 324/158 F |
| 0749630 | 7/1980 | U.S.S.R. | 221/264 |
| 1025605 | 6/1983 | U.S.S.R. | 209/573 |

*Primary Examiner*—Robert B. Reeves
*Assistant Examiner*—Donald T. Hajec
*Attorney, Agent, or Firm*—Fitzpatrick, Cella, Harper & Scinto

[57] ABSTRACT

An apparatus for testing and sorting electronic components comprises a testing device (4), an output magazine (3) having several parallel receiving ducts (34) for receiving tested components (8) and a component conveyor device (7) including a carriage (36) arranged between the testing device (4) and the output magazine (3) to move transversely to the receiving ducts (34) along a support rod (37) and an eccentric rod (38). The carriage is so engaged with the eccentric rod (38) that when the eccentric rod (38) is rotated at any position of the carriage (36) along the receiving ducts (34) the carriage swivels about the support rod (37) from a stop position to a release position to release a component (8) carried thereby to the adjacent receiving duct (34).

2 Claims, 10 Drawing Figures

DEVICE FOR CONVEYING COMPONENTS, PARTICULARLY INTEGRATED CHIPS, FROM AN INPUT MAGAZINE TO AN OUTPUT MAGAZINE

This application is a division of application Ser. No. 823,818 filed Jan. 28, 1986 (now abandoned) which is a continuation of application Ser. No. 666,875 filed Oct. 31, 1984 (now abandoned).

TECHNICAL FIELD OF THE INVENTION

The invention relates to a device for conveying components particularly integrated chips received in individual, separate receiving portions of an input magazine, to individual, separate receiving portions of an output magazine, with a testing device arranged between the input magazine and the output magazine, to which device the individual components are supplied from the receiving portions of the input magazine, one after the other, for testing, by means of a first conveyor device, and which discharges the tested components to a second conveyor device which enables the said components to be discharged to receiving portions in the output magazine established by the testing device.

BRIEF DESCRIPTION OF THE PRIOR ART

A device of the type described above is already generally known (EP-A1-7650). However, the disadvantage of this known device is that the construction of the first conveyor device incurs a relatively high cost. For the first conveyor device, in the known device, is formed by a device with a large number of output gates which must be actuated by means of an actuating device controlled by a step motor.

OBJECT OF THE INVENTION

The fundamental object of the invention is therefore to demonstrate a method, using a device of the above-mentioned type, and at a lower construction cost, for conveying the individual components from the testing device to the output magazine.

SUMMARY OF THE INVENTION

According to the present invention there is provided an apparatus for testing and sorting electronic components, which comprises an input magazine for the components, a testing device to which the components are supplied individually and consecutively from the input magazine, an output magazine with inclined separate receiving ducts, and a component conveyor device and a support rod arranged between the output magazine and the testing device. The component conveyor device is displaceable transversely to the receiving ducts along the support rod. The component conveyor device comprises an inclined component carriage which is mounted to swivel about the support rod between a stop position and a release position for the components. The component carriage is arranged such that it can be swivelled up from its stop position to its release position at any of said receiving ducts to release a component carried thereby to such receiving duct.

In a preferred arrangement there is also provided an eccentric rod and means for rotating the eccentric rod. The component carriage is also displaceable along the eccentric rod and is engaged with the eccentric rod in such a manner that rotation of the eccentric rod causes the component carriage to swivel about the support rod.

The invention is explained in greater detail below on the basis of an embodiment, with reference to drawings.

DETAILED DESCRIPTION OF THE PREFERRED EMBODIMENT

Figure 1:
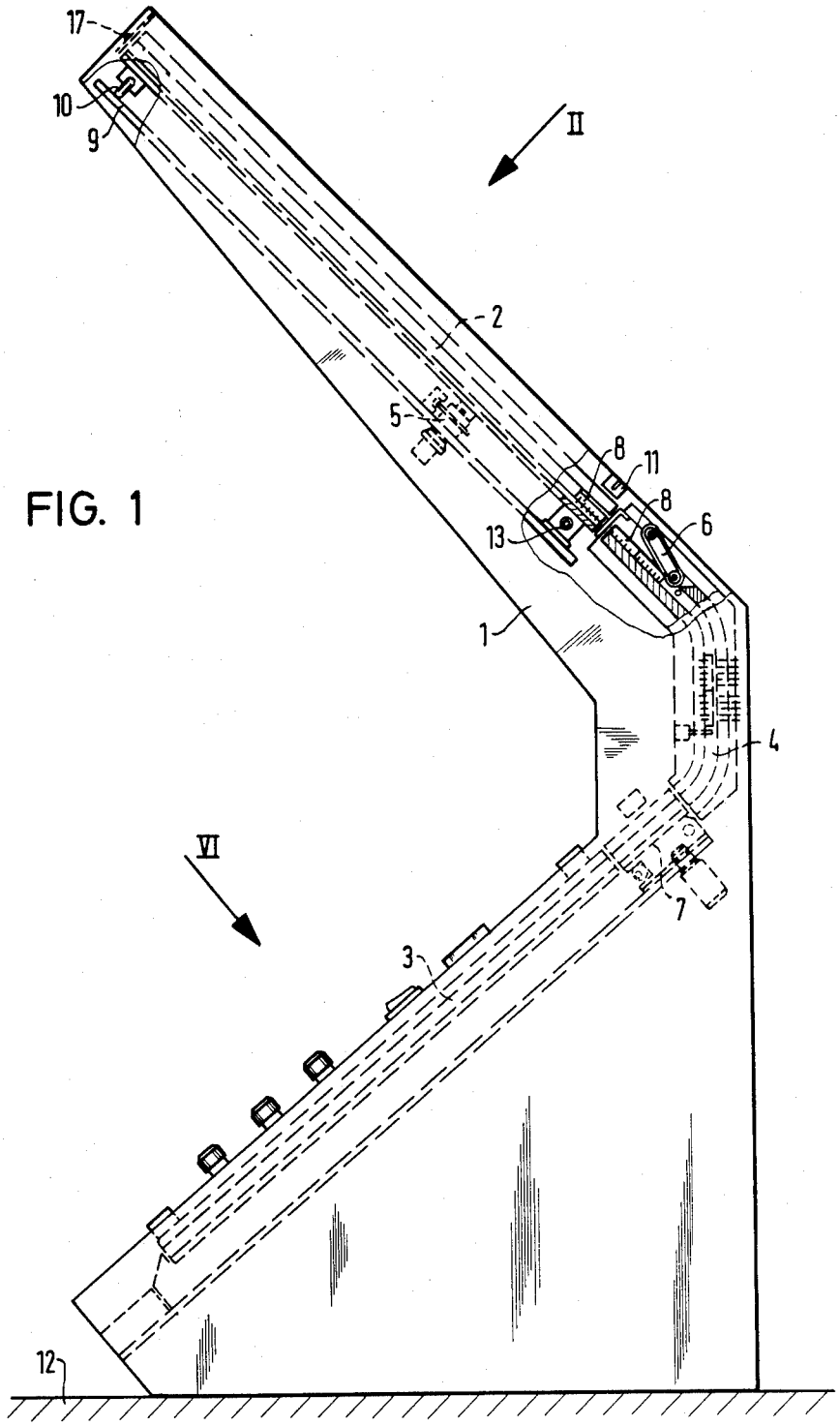
FIG. 1 shows diagramatically, on a reduced scale, a side view of a machine used for receiving and testing components, in which the device according to the invention is used.

FIG. 1 shows diagrammatically a machine 1 used for receiving and testing components. The components are in this particular case integrated chips 8, some of which are indicated in FIG. 1.

Machine 1, standing on a floor or foundation 12, exhibits in its upper area an obliquely positioned input magazine 2, and in its lower area an obliquely positioned output magazine 3. A testing device 4 is provided between input magazine 2 and output magazine 3, in which individual components 8, discharged from input magazine 2, can be tested, and from which the tested components can be discharged to output magazine 3.

Figure 2:
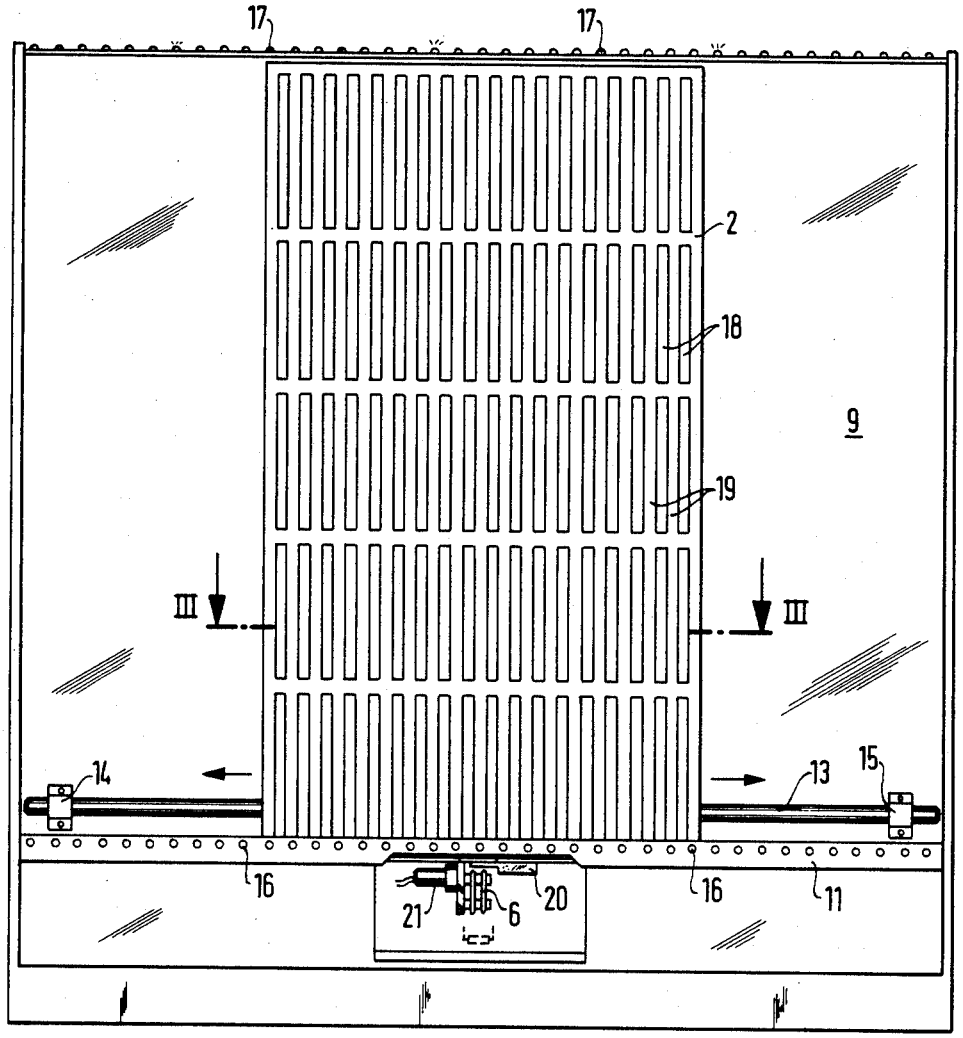
FIG. 2 shows an elevation along arrow II drawn in FIG. 1, an input magazine for receiving components.

Input magazine 2, which is shown in elevation in FIG. 2, may be displaced along a support bar 13, which is fitted to a baseplate 9 by means of fastening parts 14, 15. At a certain distance from support bar 13, input magazine 2 has at least one runner 10 which enables it to run along the baseplate on being displaced.

Figure 3:
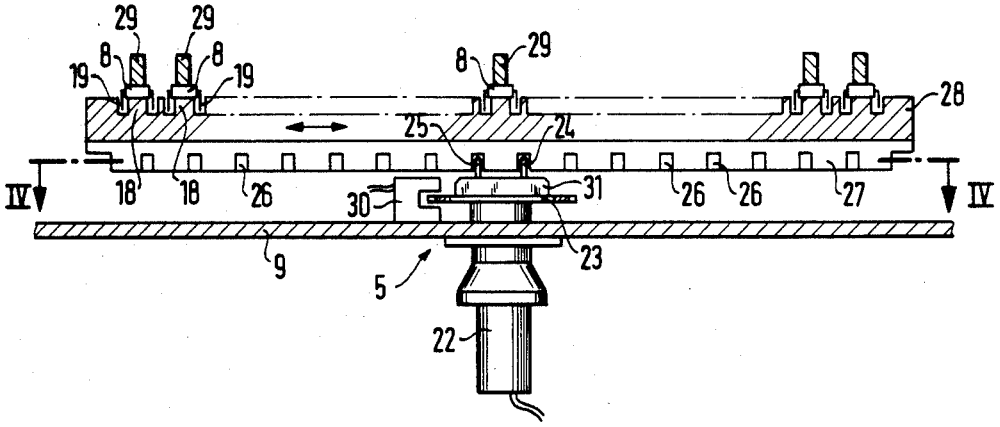
FIG. 3 shows, on an enlarged scale, a sectional view along line of section III—III drawn in FIG. 2.
Figure 4:
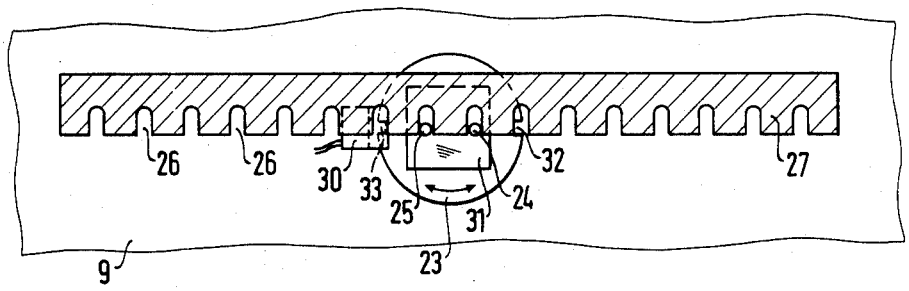
FIG. 4 shows a sectional view along line of section IV—IV drawn in FIG. 3.
Figure 5:
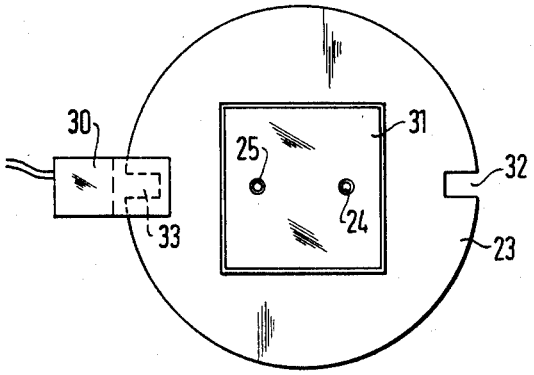
FIG. 5 shows, on an enlarged scale, an eccentric disc shown in FIG. 4.

A conveyor device 5, which is illustrated in greater detail in FIGS. 3 to 5, serves to displace input magazine 2 in the longitudinal direction of support bar 5. The said conveyor device 5 is fitted to baseplate 9, as shown in FIG. 1.

A sorting device 6 is shown in FIG. 1 in the inlet area of testing device 4. This sorting device is used to convey components supplied to it from input magazine 2, individually and consecutively, into a testing and measuring area of testing device 4. In the area of input magazine 2 devices may suitably be provided which bring the said area and hence the components in it to a desired temperature. Such devices will normally be heating devices.

As shown in FIG. 1, a further conveyor device 7 is provided between testing device 4 and output magazine 3. The purpose of this conveyor device 7 is to convey components supplied to it from testing device 4 to output magazine 3.

In addition to the previously considered elements, the machine shown diagrammatically in FIG. 1 also exhibits a fixed photoelectric gating device, generally denoted by 11, at the bottom of input magazine 2, and indicating devices 17, also fixed, above the said input magazine 2.

As shown in FIG. 2, fixed photoelectric device 11 incorporates a large number of light gates 16, which are arranged horizontally in a row, and separated by a mutual distance which is equal to the mutual distance between two adjacent component receiving portions 18 of input magazine 2. Component receiving portions 18 are formed by projections from a support plate, between which grooves 19 are formed. This arrangement of component receiving portions 18 is ideally suited for receiving integrated chips which have connections which lie in two parallel rows.

Indicating devices 17, which may be formed by light emitting diodes, are provided so that they are the same distance apart as light gates 16. Thus one light gates 16 at the bottom, and one indicating device 17 at the top, are assigned to each component receiving portion 18 in every adjustable position of input magazine 2.

Photoelectric gating device 11 is arranged, relative to the input magazine, so that, as shown in FIG. 1, it can be determined at all times whether a component 8 is contained in the said component receiving portion 18. In every adjustable position of input magazine 2, this arrangement enables the state of occupation of the individual component receiving portion 18 to be determined by means of light gates 16, so that this information can be supplied to a central processing device which will be described with reference to FIG. 10.

In connection with the processing device just mentioned it should also be pointed out that it interacts with indicating devices 17 in such a manner that, regardless of the present adjusted position of input magazine 2, those component receiving portions 18 which can be refilled are marked by a suitable indication.

The lower half of FIG. 2 shows sorting device 6, which can be driven by an electric motor 21, which device has two conveyor belts which are provided opposite an opening in a contact plate located underneath photoelectric device 11. A stop element 20 is provided between the said opening, whose size is such that only components can pass through from one component receiving portion 18 at a time, and sorting device 6. This stop element 20, which should preferably be actuated by an electromagnet, is used for supplying components from input magazine 2 to a suitable point of contact on sorting device 6, and to move input magazine 2 relative to sorting device 6, which has a fixed arrangement. This function could also be performed in principle without a separating stop device 20, if sorting device 6, or the device supporting it, were to be swivelled at right angles to the drawing plane.

FIG. 3 illustrates in greater detail, in an enlarged side view, conveyor device 5, shown diagramatically in FIG. 1, which device is used as the first conveyor device for moving input magazine 2 in the direction of the arrow drawn in FIG. 2. The said conveyor device 5 incorporates a normal electric motor 22, which is fitted to baseplate 9 and which, on its drive shaft, not shown in greater detail, supports an eccentric disc 23, on the top of which is fitted a square section 31, from which eccentric pins 24, 25 project. The arrangement of eccentric pins 24, 25 is chosen so that they lie on a line which runs through the centre of eccentric disc 23, as shown in FIGS. 4 and 5.

Eccentric pins 24, 25, which in practice project from eccentric disc 23, engage openings 26 of a rack-type rail element 27, which is connected to input magazine 2, or forms part of this magazine. Openings 26 are of such a shape and depth that eccentric pins 24, 25 are able to move in the said openings 26, in the course of rotation of eccentric disc 23, thus enabling input magazine 2 to travel a defined distance. This distance is equal to the distance between the two eccentric pins 24 and 25.

As shown in FIG. 4, eccentric disc 23 is always stopped in a position in which the line of connection between the centre of eccentric disc 23 and eccentric elements or eccentric pins 24, 25 runs in the direction of displacement of input magazine 2. This ensures that in practice the input magazine stops automatically so that it cannot be displaced accidentally.

In order to guarantee the above-mentioned adjustment of the eccentric disc in the stopping position, a position fixing device is provided in the form of a single photodetector gate 30, which has a light transmitter and a light receiver, and which enables the appearance of one recess out of two diametrically opposite recesses 32, 33 round the periphery of eccentric disc 23 to be detected. The said photodetector gate is connected to the control device already mentioned.

FIG. 3 also shows that a support plate 28, belonging to input magazine 2, is provided with component receiving portions 18, which are capable of receiving components, which may in this case be integrated chips 8. The connections of the said integrated chips 8 are in this case received by grooves 19 which are provided on both sides of the said component receiving portions 18. In order to prevent the components or integrated chips 8 from falling from their component receiving portions 18, the said components or integrated chips 8 are covered on top with a cover rail 29, as indicated in FIG. 3.

With regard to the configuration of component receiving portions 18 and grooves 19, shown specially in FIG. 3, it should also be noted that the support plate struts provided between two adjacent grooves are not drawn separately in FIG. 2; moreover, the object may in principle also be achieved without such struts.

Figure 6:
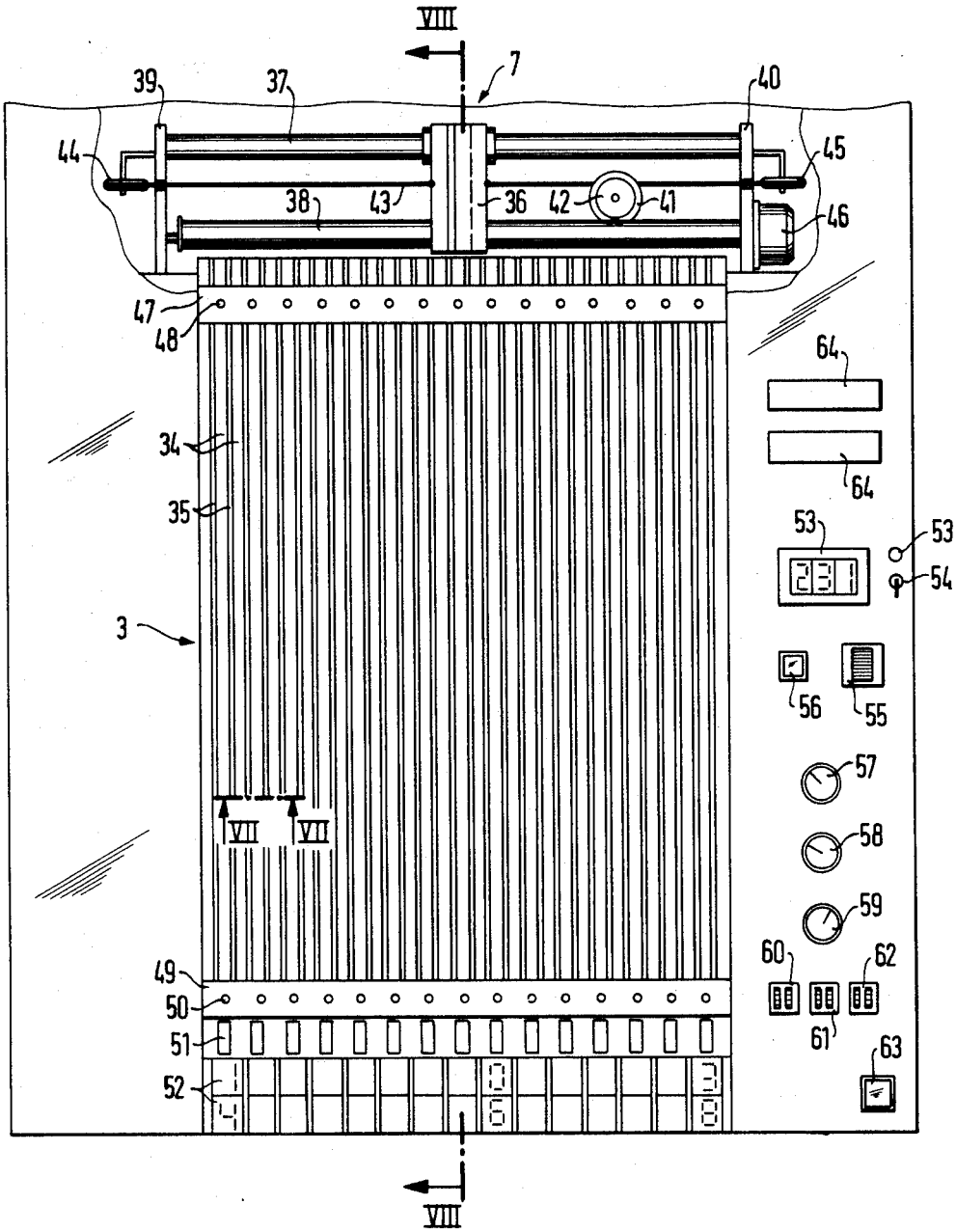
FIG. 6 shows, in an elevation, along arrow VI drawn in FIG. 1, an output magazine for components.

FIG. 6 illustrates in greater detail, in an elevation, output magazine 3 used in the machine shown in FIG. 1, together with the associated second conveyor device 7. However, output magazine 3 is in this case illustrated without the use of cover rails, which ensure that components supplied to output magazine 3 cannot jump out of it.

Figure 7:
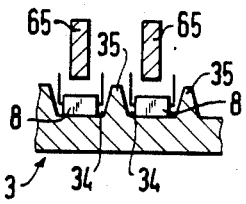
FIG. 7 shows an enlarged sectional view along line of section VII—VII drawn in FIG. 6.

Output magazine 3 shown in FIG. 6, has a series of parallel ducts 34, which are separated by projections or struts 35, as shown in the enlarged partial sectional view in FIG. 7. Ducts 34 are designed so that they are capable of receiving components or integrated chips 8, which are now, of course, located to the rear to a certain degree. In this connection, FIG. 7 illustrates the use of cover rails 65, which ensure that components 8 cannot escape from ducts 34.

As shown in FIG. 6, output magazine 3 exhibits, on its upper side representing the inlet side, a photoelectric gating device 47, with a row of light gates 48, and in its lower area, serving as the outlet area, a light gate arrangement 49, with a series of light gates 50. The said light gates each comprise a light transmitter and a light receiver. Their arrangement is such that one light gate per duct or component recess 34 is provided in each photoelectric gating device. This enables the said light gates to detect the entry of components or integrated chips located within their range.

Figure 8:
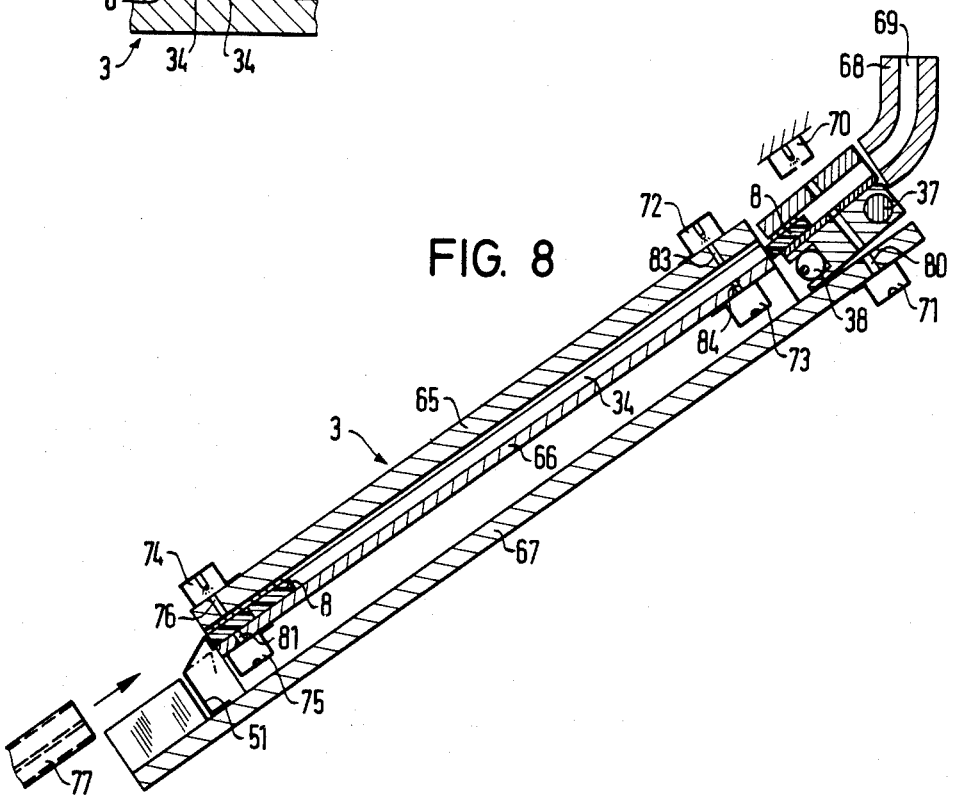
FIG. 8 shows a sectional view along line of section VIII—VIII drawn in FIG. 6.

The individual component receiving portions or ducts 34 are sealed underneath photoelectric gating device 49 by springs 51, which have the shape shown in FIG. 8.

According to FIG. 6, the individual ducts 34 of output magazine 3 are provided with indicating devices 52, which are storage and indicating devices whose indicating section is in this case a digital indicating section comprising two indicating elements. These indicating elements may, for example, be formed by two seven-segment indicating elements. Indicated values which relate to the measuring and test classes into which the components discharged from testing device 4 to output magazine 3 are to be sorted, can be stored and indicated (displayed) by means of these storage and indicating devices 52. More details are given of the processes relating to this with reference to FIG. 10.

FIG. 6 illustrates in greater detail, above output magazine 3, the second conveyor device 7, already mentioned in connection with FIG. 1. This conveyor device 7 comprises a carriage 36, which can be moved along a guide rod 37 and along an eccentric rod 38, by means of a drive motor 41, which is a normal step motor. The said motor 41 supports a rope pulley 42 round which is wound a rope 43, attached to carriage 36, which rope is also wound round two rope pulleys 44, 45 fitted to support plates 39 and 40 respectively.

The aforementioned eccentric rod 38, in whose longitudinal direction carriage 36 may be moved, may be rotated by means of an electric motor 46 fitted to support plate 40.

In addition to the previously considered elements, FIG. 6 shows further adjusting and indicating elements. These indicating elements include, among other things, a temperature or heat indicating device 53, which provides a heating temperature indication and a heating control. Also provided is a switch 54, with which the heating can be switched on separately, the heating system being located in the area in front of sorting device 6 shown in FIG. 1. Also provided, according to FIG. 6, are a further heating adjustment device 52, and a heating control indicating device 56. The mode of operation of output magazine 3 can be set by means of a setter (adjuster) 57, and the mode of operation of the entire machine can be set by means of a setter (adjuster) 58. A heating temperature may be set by means of a setter (adjuster) 59, and the capacity per component duct 34 of output magazine 3 may be preselected by means of a setting device 60. The holding time in the above-mentioned heating area, in front of sorting device 6 shown in FIG. 1, may be selected by means of a setter 61. The repetition of test processes in testing device 4 may be set by means of a switch 62. An on/off indicating device 63 indicates whether the entire system is in the on or off condition.

In addition to the above-mentioned indicating and adjusting elements, FIG. 6 shows further indicating and adjusting elements 64, which may be provided for various purposes, for example for indicating the times determining the execution of test processes in the system concerned.

FIG. 8 illustrates in greater detail output magazine 3 shown in FIG. 6, together with conveyor device 7, and a section of the testing device, in a sectional view. According to FIG. 8, a baseplate 67, to which s fitted output magazine 3, by means of fastening plates not shown in greater detail, is located underneath support device 3 and underneath conveyor device 7. FIG. 8 shows a support plate 66, of output magazine 3, which plate has received two components 8 in a duct 34. In FIG. 8, one of cover rails 65 already mentioned in connection with FIG. 7, is provided above the said components.

A light transmitter 72, and a light receiver 73, are provided at the upper inlet end of output magazine 3, as shown in FIG. 8. Light transmitter 72, together with light receiver 73, form one of light gates 48 illustrated in FIG. 6. The light emitted from light transmitter 72 passes through openings 83, 84 located in cover rail 65 and support plate 66 respectively.

A light transmitter 74 and a light receiver 75 are arranged at the lower outlet end of output magazine 3, as shown in FIG. 8. Light transmitter 74 and light receiver 75 each form one of light gates 50 shown in FIG. 6. The light emitted from light transmitter 74 is able to pass through openings 76, 81 located in cover rail 65 and support plate 66 respectively. However, the light emitted from light transmitter 74 is only able to reach associated light receiver 75 when there is no component 8 in the relevant light path in the area of duct 34 serving as the component duct.

A stirrup type spring 51 closes against the outlet area of duct 34 of output magazine 3. This spring 51 may be forced down by presenting a bar magazine 77 to the relevant outlet end of output magazine 3, so that components 8 contained in the associated duct 34 of output magazine 3 can slide out and be collected (received) by bar magazine 77. Once the emptying process is completed, spring 51 again seals the associated duct 34.

According to FIG. 8, conveyor device, in its component receiving position, is located at the inlet end of output magazine 3. In this position eccentric rod 38 is adjusted so that a component 8 contained in the said conveyor device 7 is able to strike against the front of support plate 66 of output magazine 3, but cannot enter duct 34, which lies exactly opposite conveyor device 7 and hence the said component 8.

On the component inlet side of conveyor device 7 is shown a photoelectric gating device consisting of a fixed light transmitter 70, and a light receiver 71, also in a fixed arrangement. The light emitted from light transmitter 70 is able to reach the associated light receiver 71 through an opening 80 made in baseplate 67. The light path in question is permeable in the area in which conveyor device 7 is located. The signals thus obtained from the aforementioned light gating device can be used and are used for suitable adjustment of conveyor device 7 relative to testing device 4. Conveyor device 7 can therefore be moved along guide rod 37 and eccentric rod 38 into any desired adjusting position.

FIG. 8 illustrates diagrammatically a component discharge section of the testing device on the component inlet side of conveyor device 7. The testing device discharges tested components to conveyor device 7 through a component duct 69 of this component discharge section 68.

Figure 9:
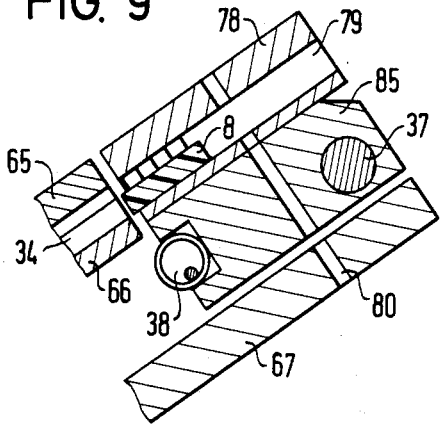
FIG. 9 shows, on an enlarged scale, a sectional view of a conveyor device already shown in FIG. 8.

FIG. 9 illustrates in greater detail conveyor device 7 shown in FIG. 8, in an enlarged sectional view. According to FIG. 9, conveyor device 7 is shown in its component discharge position. In this position eccentric rod 38 is rotated as shown in FIG. 8 relative to the adjusting position. In the position shown in FIG. 9, a component 8, contained in a component duct 79 of a component receiving section 78 of conveyor device 7, is able to slide out and into duct 34, forming a component duct, which duct is located in output magazine 3, of which only the associated support plate 66 and a cover rail 65 is illustrated in FIG. 9.

Below component receiving section 78 is located a support section 85, which can be moved along support rod 37, and also along eccentric rod 38, and which can be swivelled by the rotation of eccentric rod 38 about support rod 37. In the course of such swivelling the component receiving section 78 is also swivelled correspondingly.

FIG. 9 illustrates baseplate 67, below support section 85, with one of its openings 80.

Figure 10:
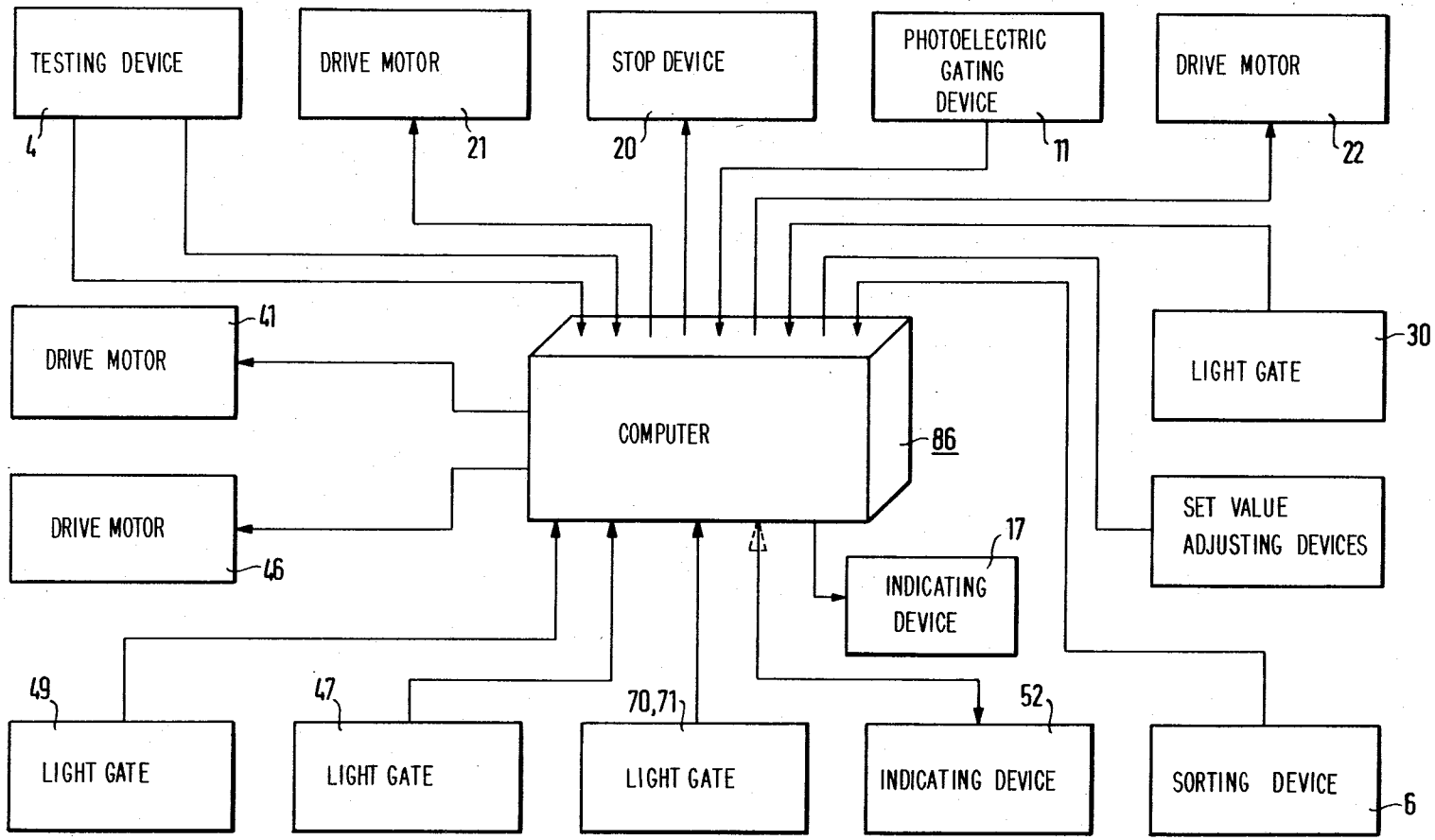
FIG. 10 shows, in a block diagram, one possible construction of a control device which controls the operation of the machine shown in FIG. 1.

In a block diagram FIG. 10 illustrates the control device already mentioned in the course of the above description. This control device comprises, among other things, a computer 86, which may take the form of a microcomputer, with at least one microprocessor, a program memory and a working memory. This computer 86 is supplied with a series of information signals which it requires for determining (detecting) control signals. The control signals are transmitted to a number of devices.

Information signals are transmitted to computer 86 from photoelectric gating device 11, from light gate 30, from a light gate provided behind sorting device 6, from light gating device 70, 71, from light gate device 47, from light gate device 49, from testing device 4 and from the set value adjusting devices which enable the temperature and holding time of components to be tested to be adjusted in the testing device, for example.

The control signals generated by computer 86 are transmitted essentially to indicating device 17, indicating device 52, as well as to drive motors 21, 22, 41, 47, and to stop device 20. Indicating device 52 may, in contrast to the conditions shown in FIG. 10, also be connected to computer 86 for transmitting information signals, where this device 52 is a storage and indicating device which enables information values associated with individual component test and measuring classes to be stored and indicated.

The control system for conveying individual components 8 to be tested from input magazine 2 to testing device 4, and the control system for the discharge of such tested components from testing device 4, need not be explained further here.

The processes relating to this control system must be considered as normal control processes. Because of their particular significance, however, the processes which take place for the conveying and distribution of components 8 discharged from testing device 4 are considered in the following. These processes are illustrated in greater detail below with reference to FIG. 6.

When conveyor device 7 has received a component 8 from testing device 4, testing device 4 has supplied computer 86 with information on the test and measuring class into which the component in question falls. Computer 86 then determines whether a component receiving portion reception associated with such a test and measuring class already exists in output magazine 3. If the individual component receiving ducts of output magazine 3 are permanently allocated to different test or measuring classes, computer 86 can quickly establish the appropriate component receiving portion of output magazine 3. Conveyor device 7 is then moved to the appropriate component receiving portion, for which purpose a suitable control signal is transmitted to drive motor 41. When the desired setting position is reached, as a result of the response by computer 86, computer 86 transmits a control signal to drive motor 46, which then swivels conveyor device 7 so that the component is discharged into the appropriate component receiving portion of output magazine 3. Computer 86 then transmits further control signals to drive motors 41 and 46 for returning conveyor device 7 to the position in which they are able to receive a further component from testing device 4.

The device according to the invention can also be operated by a method other than that just considered. The individual component receiving portions of output magazine 3 need not initially be allocated to any particular testing or measuring classes, but can be allocated in the course of conveyance of components to output magazine 3. This takes place as follows.

When an information signal on the presence of a component to be conveyed to output magazine 3 is again transmitted to computer 86, according to Fig. 10, from light barrier device 70, 71, and when computer 86 at the same time receives corresponding information signals on the appropriate testing and measuring class into which the component in question falls, from testing device 4, computer 86 may, in the event that no component receiving portion associated with this testing and measuring class is yet available, establish such a component receiving portion in output magazine 3. For this purpose computer 86 may store a suitable signal in an internal storage device, or in a storage device associated with indicating device 52, and may permit a suitable indication to be given by indicating device 52 associated with the said selected component receiving portion. Drive motors 41, 46 are then actuated (started) by suitable means, as already explained.

When a further component is to be supplied to output magazine 3 after the process just considered, which component falls into a test or measuring class for which a component receiving portion is already reserved in output magazine 3, the component in question is then conveyed by means of conveyor device to the appropriate component receiving point. This takes place with drive motors 41, 46 under the control of computer 86, which generates appropriate adjusting information from the information signals which it receives from light barrier device 70, 71, from testing device 4, and from the storage device in which the allocation of the individual component receiving portions to test and measuring classes is stored.

In order to ensure that components are also conveyed correctly to appropriate component receiving portions of output magazine 3 in cases where a component receiving portion is already filled with components, the latter condition is reported separately to computer 86. The information signals which can be transmitted to computer 86, from light gating device 47, together with adjusting signals which are transmitted to computer 86, for example, from adjusting device 60 already mentioned in connection with FIG. 6, are used for this purpose. When the pre-established number of components has been determined (detected) by means of a light gate of gating device 47, and computer 86 has recognised this, it may deduce from this that the relevant component receiving portion is full. The signals contained in the aforementioned storage device of computer 86, or in the storage device of indicating device 52 associated with the appropriate component receiving portion, can then be modified or processed in such a manner that they mark or indicate the fact that their associated component receiving portion is no longer able to receive components. When output magazine 3 is then to be supplied with a component which would have to be conveyed to a component receiving portion which is marked as incapable of receiving the component, as already described, computer 86 establishes a further component receiving portion not yet occupied, for which the appropriate test and measuring class is then established and indicated.

By the method previously described, different test and measuring classes can be flexibly determined and established in output magazine 3. It is therefore possible, without much difficulty, to receive in the individual component receiving portions of output magazine 3 components which are assigned to test and measuring classes over a very wide range, about the number of which no experience or information has yet been gained.

When a component receiving portion of an output magazine 3, which is marked as no longer able to receive components because it is already filled with components, is emptied by means of a bar magazine 77, as has been explained in connection with FIG. 8, indicating devices 52 associated with the appropriate component receiving portion, and the storage device in which the allocation between the measuring and testing class and the appropriate component receiving portion is stored, are returned to their initial conditions. The said component receiving point is therefore again available for renewed use for receiving components.

Finally it should also be pointed out that, in contrast to the conditions described in connection with FIGS. 1 to 9, the components could be received by the same method both in the input magazine and in the output magazine, for example as illustrated above with regard to the input magazine. In this case a component turning device could be suitably provided in the area of the measuring device.

What is claimed is:

1. Apparatus for testing and sorting electronic components, comprising an input magazine for the components, a testing device to which the components are supplied individually and consecutively from the input magazine, an output magazine with inclined separate receiving ducts, and a component conveyor device and a support rod arranged between the output magazine and the testing device, said component conveyor device being displaceable transversely to the receiving ducts along said support rod, said component conveyor device mounted to swivel about the support rod between a stop position and a release position for the components, said component conveyor device being provided with swivel means such that it is swivelled up from its stop position to its release position at a selected one of said receiving ducts to release a component carried thereby to such receiving duct.

2. Apparatus according to claim 1, said swivel means further comprising an eccentric rod and means for rotating said eccentic rod, said component conveyor device also being displaceable along said eccentric rod, said conveyor device engaging the eccentric rod in such a manner that rotation of the eccentric rod causes the conveyor device to swivel about the support rod.

* * * * *